US007182007B2

(12) United States Patent
Berge et al.

(10) Patent No.: US 7,182,007 B2
(45) Date of Patent: Feb. 27, 2007

(54) METHOD FOR DYNAMICALLY ALIGNING SUBSTRATES BEARING PRINTED REFERENCE MARKS AND CODES FOR AUTOMATED CUTTING OR SCORING, AND SUBSTRATES SO CUT OR SCORED

(75) Inventors: John Berge, Kongsberg (NO); Martin Reggestad, Hokksund (NO)

(73) Assignee: Esko-Graphics A/S, Lystrup (DK)

( * ) Notice: Subject to any disclaimer, the term of this patent is extended or adjusted under 35 U.S.C. 154(b) by 343 days.

(21) Appl. No.: 10/769,736

(22) Filed: Jan. 29, 2004

(65) Prior Publication Data

US 2005/0166744 A1 Aug. 4, 2005

(51) Int. Cl.
*B26D 5/00* (2006.01)
*B26D 1/04* (2006.01)

(52) U.S. Cl. ..... 83/13; 83/76.8; 83/364; 83/371; 83/880; 270/5.02; 271/98; 271/227

(58) Field of Classification Search ..... 83/13, 83/62.1, DIG. 1, 879, 880, 412, 371, 39, 83/76.8, 76.7, 365, 370, 364, 368, 34, 75.5, 83/79, 75, 74; 271/10.1, 102, 3.13, 3.15; 270/1.1, 45; 347/157; 700/259
See application file for complete search history.

(56) References Cited

U.S. PATENT DOCUMENTS 4,071,899 A 1/1978 Holy ..... 364/561
4,098,158 A * 7/1978 Escales et al. ..... 83/27
4,483,527 A * 11/1984 Hashimoto et al. ..... 271/5
4,884,796 A * 12/1989 Daboub ..... 271/111
5,366,307 A 11/1994 McGourty et al. ..... 400/708
5,601,389 A * 2/1997 Minami ..... 412/14
5,651,618 A * 7/1997 Tamiya ..... 400/70
5,705,020 A * 1/1998 Chiari ..... 156/350
6,059,705 A 5/2000 Ruthenberg et al. ..... 493/11
6,155,555 A * 12/2000 Maass ..... 271/98
6,160,609 A * 12/2000 Inoue ..... 355/41
6,196,098 B1 * 3/2001 Hagiwara et al. ..... 83/79
6,619,167 B2 9/2003 Mikkelsen et al. ..... 83/13
6,619,168 B2 9/2003 Alsten et al. ..... 83/13

(Continued)

FOREIGN PATENT DOCUMENTS

DE 19842617 A1 3/2000

(Continued)

*Primary Examiner*—Boyer D. Ashley
*Assistant Examiner*—Ghassem Alie
(74) *Attorney, Agent, or Firm*—Dov Rosenfeld; Inventek

(57) ABSTRACT

A substrate to be cut and/or scored is pre-printed with graphics, at least first and second registration marks, and optional encoded-to-print instructions, bar-encoded data, as well as ordinary graphics. The registration marks are sensed as the substrate is automatically transported to a cutting table station that defines a cutting reference plane. Sensed detection of location of the registration marks relative to the reference plane enable the cutting plan for the substrate to be amended for precise location of the graphics on the substrate relative to the reference plane. Automated cutting according to the amended cutting plan occurs. As the registration marks were printed simultaneously with and in known relationship to the graphics, the cut line will be precise relative to the graphics. Machine readable encoded-to-print instructions optionally printed on the substrate can further amend the cutting plan.

8 Claims, 7 Drawing Sheets

U.S. PATENT DOCUMENTS

| | | | | |
|---|---|---|---|---|
| 6,672,187 | B2 | 1/2004 | Alsten et al. | 83/13 |
| 2002/0144578 | A1 | 10/2002 | Mikkelsen et al. | 83/13 |
| 2002/0144579 | A1* | 10/2002 | Alsten et al. | 83/13 |
| 2003/0033918 | A1* | 2/2003 | Maddalon | 83/74 |
| 2003/0047045 | A1 | 3/2003 | Alsten et al. | 83/13 |

FOREIGN PATENT DOCUMENTS

| | | | |
|---|---|---|---|
| EP | 0704283 | A1 | 4/1996 |
| EP | 0 810 914 | B1 | 10/1998 |
| WO | WO 96/26047 | | 8/1996 |
| WO | WO 02/081158 | A1 | 10/2002 |
| WO | WO 2005/066881 | A1 | 7/2005 |

* cited by examiner

FRONT END COMPUTER SYSTEM

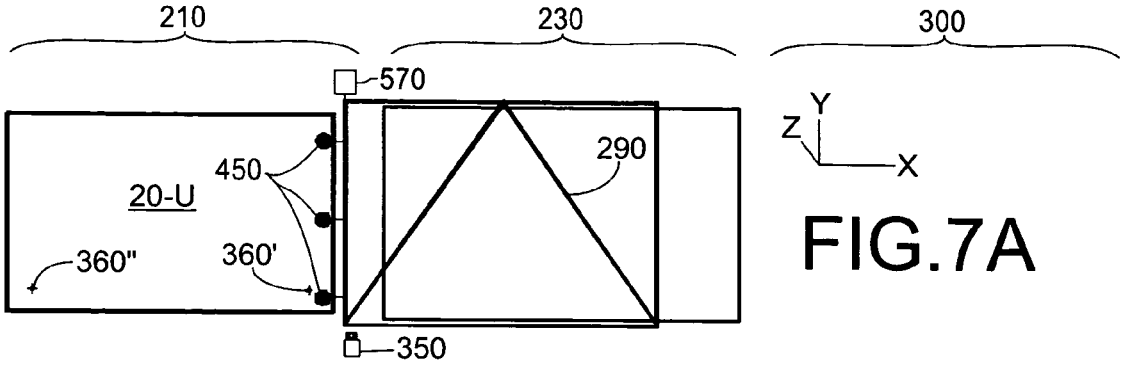
FIG.7A
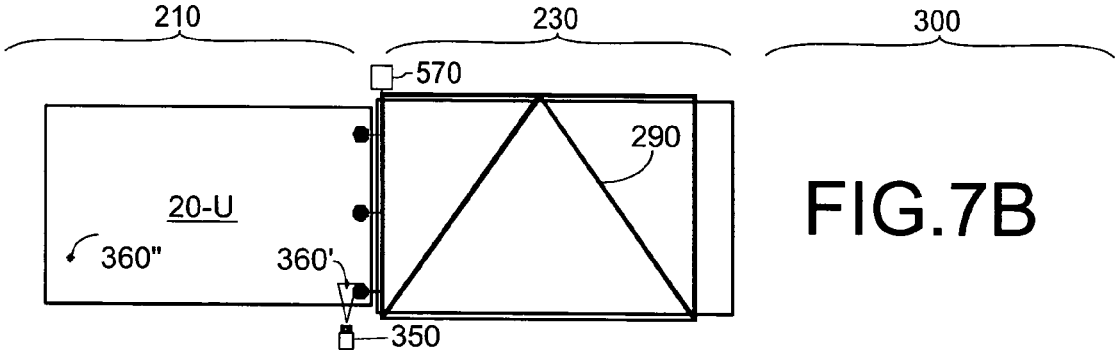
FIG.7B
FIG.7C
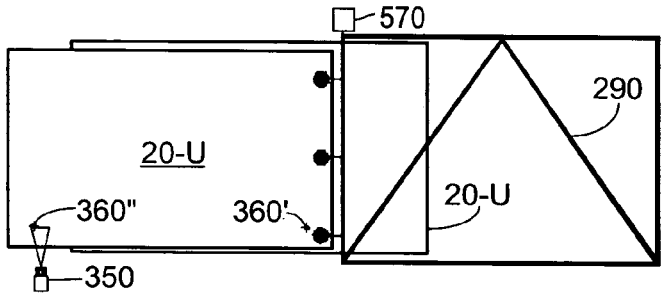
FIG.7D
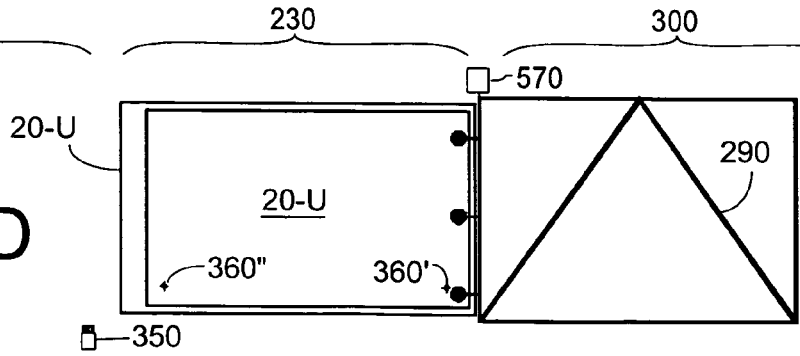

METHOD FOR DYNAMICALLY ALIGNING SUBSTRATES BEARING PRINTED REFERENCE MARKS AND CODES FOR AUTOMATED CUTTING OR SCORING, AND SUBSTRATES SO CUT OR SCORED

FIELD OF THE INVENTION

The present invention relates generally to automated cutting and/or scoring (hereinafter collectively "cutting") of substrates bearing pre-printed graphics, registration marks, and optional so-called encoded-into-print instructions, e.g., barcoded instructions, and more specifically to dynamically detecting the registration marks for use in correcting the cutting plan for any substrate positional or alignment error on a cutting table station whereat cutting occurs, modifying the cutting plan according to any relevant encoded-into-print instructions, and to automatically cutting the substrate to achieve rapid and precise alignment of the cutting relative to the graphics.

BACKGROUND OF THE INVENTION

Containers, cartons, boxes, placards and the like are commonly formed from a planar substrate such as cardboard, although other material may be used. The substrate is often printed with graphics, and may be scored and/or cut to form a not necessarily rectangular advertising medium, among other applications. It may be desired to cut (and/or score) the substrate around the perimeter of a pre-printed graphics, for example, which perimeter may be along a locus having varying direction, or along the dimensions of a box on which the pre-printed graphics should be positioned.

In some applications, the substrate may be cut first and then be printed with graphics. These various operations are sometimes referred to as short run cutting and scoring. Although short run operations can be carried out in various ways, it is always desired that cutting be in proper alignment with graphics, and that good speed and efficiency, collectively "throughput", be maintained during the various processing operations. Note that by "short run production" is meant the production of a relative low volume.

FIG. 1 depicts an exemplary prior art automated short run cutting and scoring system 10 that cuts a planar substrate 20 that typically is pre-printed with encoded-into-print instructions 30, registration or alignment marks 40 (hereafter collectively denoted registration marks), and typically graphics 50. The terms "encoded instructions" or "bar-encoded instructions" will be used hereinafter to refer to such encoded-into-print instructions, and the term "barcode" will be used to describe an exemplary format of such instructions as printed onto the substrate. Encoded instructions 30 typically include metric information such as customized cutting instructions for the specific substrate being processed, individual adjustments to be made from a standard template set of cutting instructions, and/or a set of cutting instructions.

In FIG. 1, movement of substrates 20 through system 10 will be generally from left-to-right. A feed mechanism 60 moves substrate 20 to a typically static station region 70, and the substrate is loaded into station 70 whereat substrate cutting will occur, for example responsive to the metrics represented by the encoded instructions 30. While feed mechanism 60 is depicted in FIG. 1 as a continuous conveyor belt, mechanism 60 is intended to be exemplary and generic, and may instead comprise stations whereat vertical stacks of substrates are processed.

Before cutting can occur, it is necessary that the just-loaded substrate be properly positioned and aligned at station 70, and on occasion manual intervention is required. Achieving and confirming proper positioning and alignment of the substrate before cutting occurs can be time consuming relative to overall throughput of system 10, and is relatively difficult to achieve.

At station 70, a sensor system 80 optically tries to locate and read bar encoded instructions 30. In some prior art application, bar encoded instructions can assist in more rapidly locating pre-printed registration marks 40 upon the sensor-facing surface of the substrate. Sensor system 80 may include a camera system and an associated computer system 90 to control operation of feed mechanism 60, and thus movement of substrate 20.

It is common in the prior art to use an edge of the just-loaded substrate as a reference to geometry printed on the substrate surface. However in practice, the edge of a substrate is not always sufficiently accurate to ensure that graphics are consistently located at a position a known distance from the substrate edge. Understandably if the graphics are not quite properly aligned relative to the substrate edge, when the substrate is cut, the cut-line might go through rather than around the graphics, or generate graphics that are not accurately positioned in the final folded box.

In a prior art system 10, unless the substrate can be perfectly aligned relative to the cutting table, it is necessary to modify the cutting plan based upon knowledge of such positional alignment error. Determination of such positional error and correction to the cutting plan occurs while substrate 20 is stationary at station 70. During this stationary period, feed mechanism 60 will also be stationary, for example responsive to a control signal output from computer system 90.

After computer system 90 determines position of the stationary substrate and makes any modifications to the cutting plan to compensate for positional misalignment of the substrate on the cutting table, cutting can commence at station 70. Sensor system 80 outputs a signal to computer system 90, which in turn will command cutting system 110 to cut (or score) the substrate, which is stationary at station 70. As noted, cutting can be responsive to encoded instructions present in bar codes 30 or may be responsive solely to instructions already present in computer system 90. As noted, it is desired that cutting occur in acceptable locations relative to the graphics and the desired cut and fold lines for the substrate.

Upon completion of the cutting operation at station 70, system 10 perhaps under control of computer system 90 re-starts feed mechanism 60, and the cut substrate, denoted 20' in FIG. 1, is moved off (or unloaded from) static station region 70 to an output side of system 10. At the input feed side of system 10, the next-in-line substrate 20 is moved onto region 70, whereupon feed mechanism 60 is halted. The above-described process is repeated for the new substrate, which after it is cut is moved to the output side of system 10 and unloaded from system 70.

What is needed is a computerized method and system to enable substrates pre-printed with graphics, reference alignment marks, and encoded-into-print instructions bar encoded data to be dynamically examined while being positioned on a cutting table region, and to have any required corrections made dynamically to a relevant cutting plan before cutting occurs. Such a method and system should require minimal operator intervention, and should exhibit substantially improved throughput. Further such system should lend itself to automated low volume sample production applications, in addition to full production run applications.

Aspects of the present invention provide such a computerized method and system, and substrates so cut.

SUMMARY OF THE INVENTION

Embodiments of the present invention promote throughput in a short run cutting and scoring system that transports and cuts substrates that have been simultaneously pre-printed with graphics, at least first and second registration marks, and optionally, encoded-into-print instructions that tell how the substrate is to be cut and/or scored by the system. In one embodiment, the invention includes a cutting table region whereon substrate cutting occurs, and preferably includes an in-stack region whereon substrates are stacked prior to being moved onto the cutting table region, and preferably includes an out-stack region whereon cut substrates are stacked for removal. The embodiment preferably includes a loadframe that transports substrates one at a time from the top of the in-stack, across the cutting table, and to the out-stack region. Loadframe transport velocity preferably is dynamic in that a high velocity is used to transport the substrate until the first registration mark is detected by the sensor system. Thereafter a lower loadframe velocity profile is used to ensure detection of the second registration mark with acceptable positional accuracy.

The system preferably further includes at least one sensor system that detects presence of the first and second registration marks. The detected registration mark positions are used by a computer system to correct the cutting plan for the substrate for any errors in positioning the substrate on the cutting table region. Optional encoded-into-print instructions may be read by the same sensor system or by a second sensor system for use in modifying the cutting plan for the substrate. Nominal offsets of the registration marks from the adjacent edge of the substrate will be known a priori, as will offset between the registration marks and a perimeter bounding the overall region to be cut and/or scored on the substrate. The overall x-axis dimension of the bounding box can be determined. Preferably four loadframe x-axis positions are defined: a zero-position as a substrate is picked-up from the in-stack, a first position corresponding to detection of the first registration mark (corresponding to x-axis distance from zero-position to the first registration mark), a second position corresponding to detection of the second registration mark (corresponding to x-axis distance between zero-position and the second registration mark), and a third position when the substrate is fully on the cutting table (which position information is used to calculate exact offset for the cutting and/or scoring to be carried out). The cutting table station defines a frame of reference definable by orthogonal x-and y-axes that intersect at an edge of the region. The mechanism that actually cuts the substrate uses this frame of reference.

Encoded loadframe positional information is coupled to a computer system that preferably controls the overall system including the loadframe and cutting table sensor. The computer system can calculate any required registration mark position offsets to modify reference points, as needed, to carry out the cutting and/or scoring task at hand. Similarly any required rotational positional offset for the substrate can be detected and corrected before cutting and/or scoring. The nominal cutting plan for the substrate to be cut includes a locus of coordinate (x,y) points on a two-dimensional cutting plane. The computer system uses the offset data to alter, as needed, these coordinates to correct for positional and/or rotational error. Subject to possible modification by data read from any optional encoded-into-print instructions, the corrected or updated cutting plan is then used by the computer system to control a cutting head. Since the graphics, registration marks, and optional encoded-into-print instructions were preferably simultaneously pre-printed on the substrate, good positional and rotational alignment between the graphics and the cutting line results.

Other features and advantages of embodiments of the present invention will appear from the following description in which preferred embodiments have been set forth in detail, in conjunction with the accompanying drawings.

BRIEF DESCRIPTION OF THE DRAWINGS

FIGS. 7A–7D are plan view depictions of loadframe transport of a substrate during acquisition of first and second images of reference marks, according to an embodiment of the present invention.

DETAILED DESCRIPTION OF THE PREFERRED EMBODIMENTS

As will now be described, aspects of the present invention promote throughput and high performance in a short run cutting and scoring system by optically reading registration marks on a substrate sheet while the substrate is being moved and loaded from an in-stack onto the cutting table station. Since register marks are pre-printed simultaneously with graphics (and with optional encoded-into-print instructions), the registration marks are precisely positioned relative to the graphics. Location of the registration marks may be rapidly sensed while the substrate sheet is being moved onto the cutting table station. Sensing the registration mark locations allows correcting cutting plan coordinates for any error in positional alignment including rotational offset of the substrate on the cutting table station. The cutting plan is thus adjusted to precisely accommodate the graphics on the substrate. Data read from optional encoded-into-print instructions permits altering the corrected cutting plan to accommodate a particular substrate, and/or to make adjustments from a standard template cutting plan. In an alternate embodiment, the encoded-into-print instructions include the actual cutting plan rather than variations from a prototype cutting plan. Implementation is flexible, and may be based upon existing and proven technology, for example the Kongsberg Digital Converting Machine (DCM) technology, available from Esko-Graphics located in Gent, Belgium.

Figure 1:
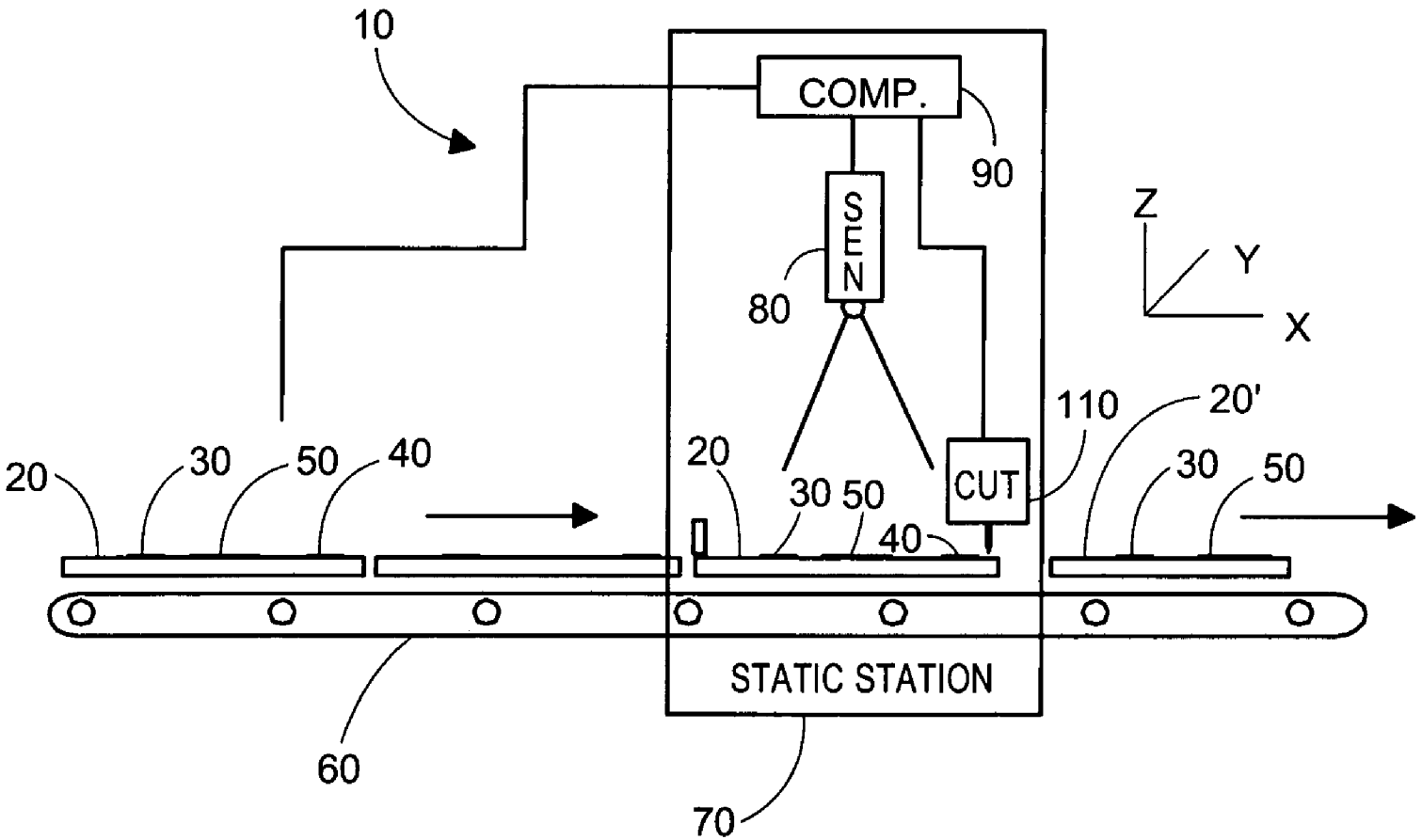
FIG. 1 (PRIOR ART)
FIG. 1 depicts a system in which registration marks and optional bar encoded data printed on a substrate are read while the substrate is stationary on a cutting station, according to the prior art.
Figure 2:
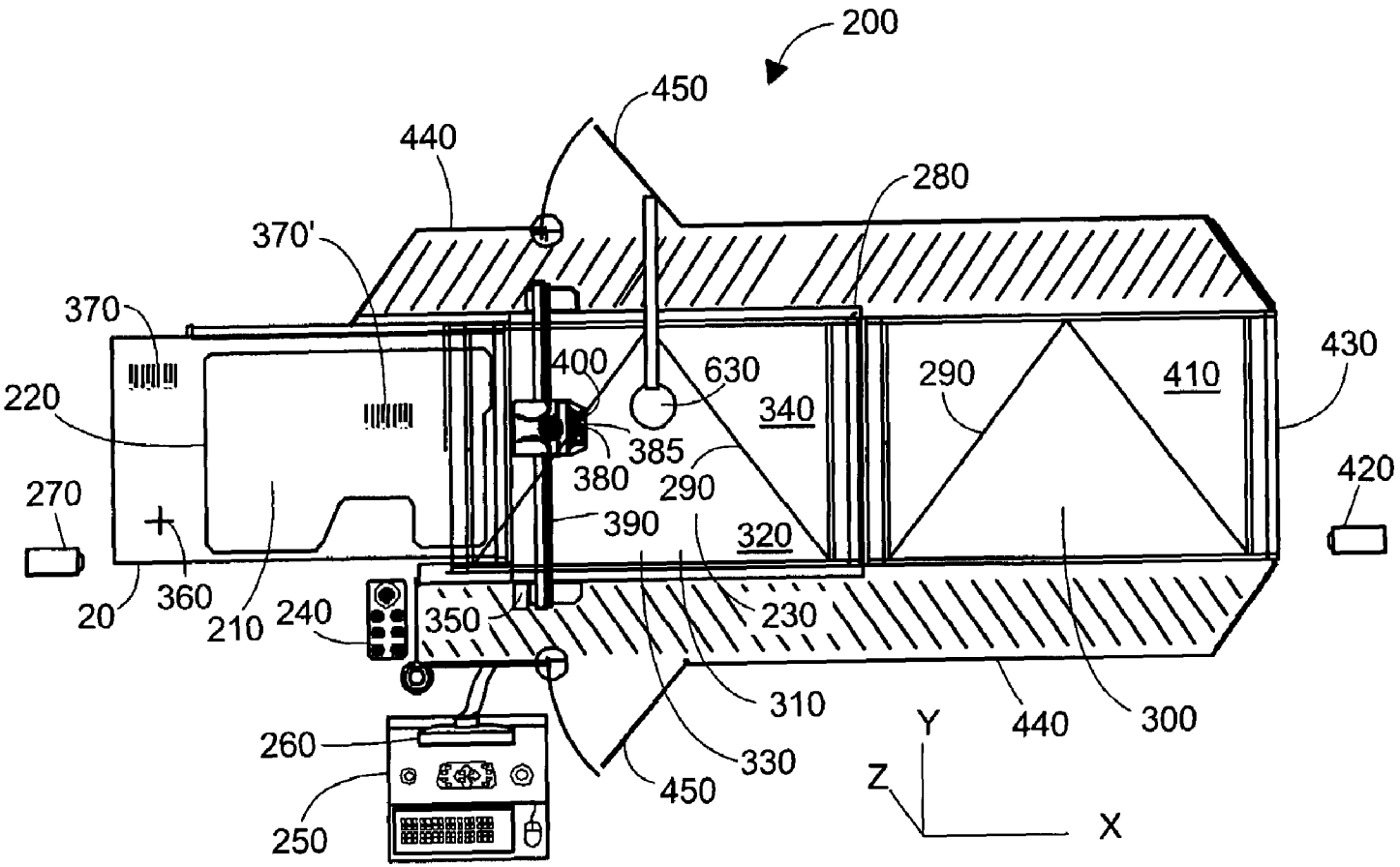
FIG. 2 is a plan view of an automated short run cutting and scoring system, according to an embodiment of the present invention.

FIG. 2 is a plan view of an automated short run cutting and scoring system 200, according to an embodiment of the present invention. System 200 includes an in-stack region 210 whereon a vertical stack of substrates 20 is placed to be moved vertically upward (along the vertical z-axis) via a lift table 220. The uppermost substrate in the stack, denoted as substrate 20-U, will be transported rightward (in FIG. 2) to cutting table station 230 to be cut (and/or scored and/or creased). Such transport preferably is provided by loadframe 290, described later herein.

Associated with lift table 220 is a lift table operator's panel 240 with controls to allow human supervision, if needed, of the stack lifting operation. An overall system 200 operator's control panel 250 and front-end computer system 260 are typically, but not necessarily, disposed near the lift table operator's panel 240. (Details of an exemplary front-end computer system 260 are shown in FIG. 5, described later herein.)

After each successive top-most substrate 20-U is moved horizontally along the x-axis (in FIG. 2) from the in-stack onto cutting table station 230, a photo sensor 270 mounted at the edge of the stack senses such movement and outputs a signal. The sensor output signal causes lift table 220 to move incrementally upward a distance $\Delta Z$ that approximates the thickness of a substrate 20. As a result, the uppermost substrate in the in-stack preferably is automatically placed at a height appropriate to be transported horizontally by loadframe 290 onto cutting table station 230.

Transport of uppermost substrate 20-U from in-stack region 210, onto and then off of cutting table station 230, and to out-stack region 300 will now be described. A traverse member 280 preferably is moved over the top region of the in-stack sufficiently to enable loadframe 290 to grip the front (right-most) edge of upper-most substrate, denoted 20-U. In one embodiment, loadframe 290 includes vacuum or suction cups (best seen in FIGS. 3A–3C) to manipulate substrates. In FIG. 2, for ease of illustration loadframe 290 is shown overlying out-stack region 300 of system 200, and as such is shown in phantom overlying cutting table station 230. Preferably loadframe 290 provides substrate transport in continuous movement, but not necessarily with constant velocity, as described later herein.

In one embodiment, cutting table station 230 includes at least one base frame 310, each base frame preferably covered with a plastic cover 320. Cutting table station 230 includes a cutting table top surface 330 per se, and a preferably vacuum-based system 340 to hold down material (e.g., substrate 20-U) firmly against surface 330.

In practice, an uppermost substrate sheet 20-U preferably is automatically transported by loadframe 290 from the top of in-stack region 210 onto cutting table station 230 where vacuum-based system 340 secures the moving substrate against table surface 330. As substrate 20-U is being transported across surface 330, cutting table sensor system 350 examines the upper (or lower) surface of substrate 20-U for pre-printed registration marks 360, 360', 360" and preferably for any optional encoded-into-print instructions 370, 370'. The location, number of, and type of marks and data depicted in FIG. 2 is understood to be exemplary. While instructions 370, 370' in FIG. 2 are depicted as one-dimensional barcodes for ease of illustration, instructions may be printed on substrate 20-U in other formats, including without limitation two-dimensional barcodes (also called glyphs), three-dimensional barcodes, etc. Optional instructions 370 and/or 370' may include the entire cutting plan for the substrate, instructions specific to the particular substrate about to cut, or adjustments from a standard template cutting plan. Not that while in one configuration as described herein, graphics is on the bottom side of the substrate, in an alternate configuration, the graphics may be on the top side of the substrate, or on both the bottom and the top.

As described later herein with respect to FIGS. 7A–7D, in one embodiment, sensor system 350 optically acquires at least two images from the moving substrate that identify at least first and second pre-printed registration marks 360', 360". Registration mark positional data acquired from sensor system 350 preferably is coupled to computer system 260, which executes a software program that can dynamically adjust the relevant cutting plan. The adjusted plan may include dX and/or dY coordinate offsets, and/or rotational offset information. As noted, the adjusted plan will also include input from any relevant instructions 370, 370". Although computer system 260 is used in one embodiment to correct the cutting plan for positional and/or rotational error, and to take into account any encoded-into-print instructions, other computer systems could instead be used.

At this juncture, substrate 20-U is securely on the surface 330 of cutting table station 230, and relevant corrections for the position of the substrate relative to the x-axis, y-axis reference frame of the cutting table station have been accounted for within the cutting plan, using sensor-acquired registration mark data. Also optional instructions 370, 370' will also have been read into computer system 260 (or equivalent system) and will be input to make relevant modification to the cutting plan, or, in an alternate embodiment, the plan itself.

Within system 200, a tool head mechanism 380 includes a knife tip that projects controllably into the substrate. The knife tip portion of mechanism 380 extends only partially into the substrate for scoring, but extends completely through for substrate cutting. Mostly, scoring is carried out by a separate tool equipped with a score wheel. Movement of the knife tip to trace the locus of desired scoring and/or cutting lines (cut-line) in or through substrate 20-U preferably occurs under control of computer system 260. As such, movement of mechanism 380 can be horizontally in the (x,y) plane along y-axis carriage 390, as well as vertically upward and downward (along the z-axis). In one embodiment; the x-axis, y-axis frame of reference for cutting table surface 330 defines the frame of reference for tool head mechanism 380. (In the embodiment of FIG. 2, cutting and scoring is executed from the top of the substrate.)

Preferably after substrate cutting or scoring is complete, the tip of the knife is permitted to move or drop downward along the z-axis onto a measuring pad 400 to ensure that the knife blade is still intact. This check of knife blade integrity can be carried out within a relatively short time period, e.g., a second or so.

In the embodiment shown, after tool head mechanism and associated knife tip 380 have completed cutting and/or scoring substrate 20-U, loadframe 290 moves the thus-processed substrate onto out-stack region 300. Preferably the out-stack region is disposed on a lift table system 410.

An overhead sensor system 420 detects when a newly processed substrate sheet has been added to the top of the stack of substrates in out-stack region 300, and outputs a signal when such event is sensed. This sensor output signal then causes lift table system 410 to decrement in elevation a vertical distance ΔZ that approximates the substrate thickness, for example under control of computer system 260. Preferably out-stack region 300 is disposed such that processed substrate sheets are properly stacked, a feature that simplifies subsequent stripping operations.

In one embodiment, an out-stack door 430 is disposed adjacent region 300. Preferably when door 430 is opened, the lift table system 410 moves downward in elevation to permit pallet removal and transportation (not shown) of the processed substrates. Preferably when door 430 is closed, the lift table system 410 moves vertically upward to the correct height. Such vertical movement may, but need not be, under control of computer system 260.

Preferably a safety fence 440 is installed around system 200 to protect nearby personnel from the automated, rapidly functioning system, with safety fence doors 450 provided for operator access, as needed.

Figure 3A:
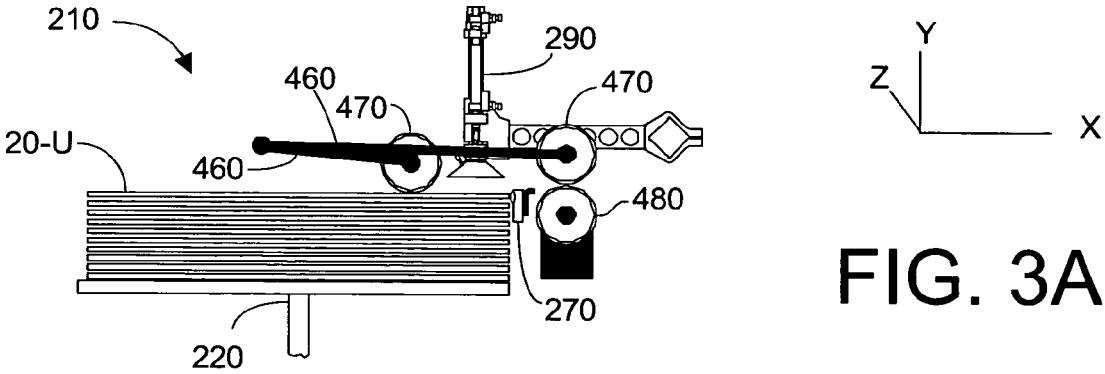
FIGS. 3A–3C are side views depicting sensor detection of loadframe transport of substrates and incremental in-stack height adjustment, according to an embodiment of the present invention.
Figure 3B:
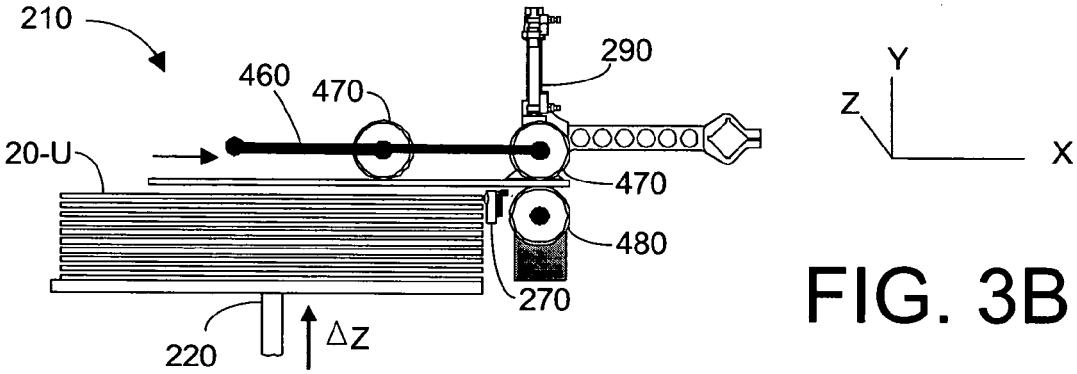
Figure 3C:
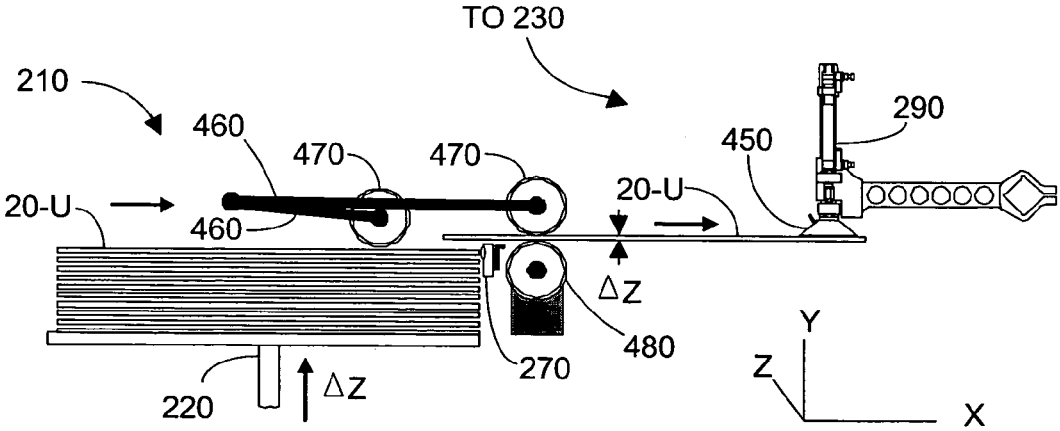

FIGS. 3A–3C depict transport by loadframe 290 and associated vacuum suction cups 450 of an uppermost substrate sheet 20-U from in-stack region 210 towards cutting table station 230. In the embodiment shown, a pair of pivotally joined arms 460 coupled to upper rollers 470 help retain substrate 20-U in alignment in cooperation with a lower roller 480. As noted above, in-stack sensor 270 optically detects lateral movement of upper substrate 20-U and, preferably via computer system 260, causes in-stack system 220 to move the stack of substrates upwards a distance ΔZ corresponding to nominal substrate thickness. Ideally uppermost substrate 20-U is held at a constant offset height above in-stack sensor system 270.

As noted, the above-described embodiment of the present invention makes use of registration marks 360 and any optional encoded-into-print instructions 370 to dynamically correct, as needed, and optionally alter the cut plan for the substrate at hand, or in an alternate embodiment, to read the cutting plan itself. It is advantageous to at least pre-print registration marks 360 simultaneously with graphics 375 to ensure that the geometric relationship between these marks and the graphics on the substrate is known. Precise location of optional barcodes or other format encoded-into-print instructions is less critical, but it may be convenient to also print such instructions 370 simultaneously with graphics 375 and registration marks 360. The encoded-into-print instructions 370 may be printed on surfaces of the substrate that will not be readily visible when the carton, box, or other structure that will result from the processed substrate is formed.

Figures 4A, 4B, 4C, 4D:
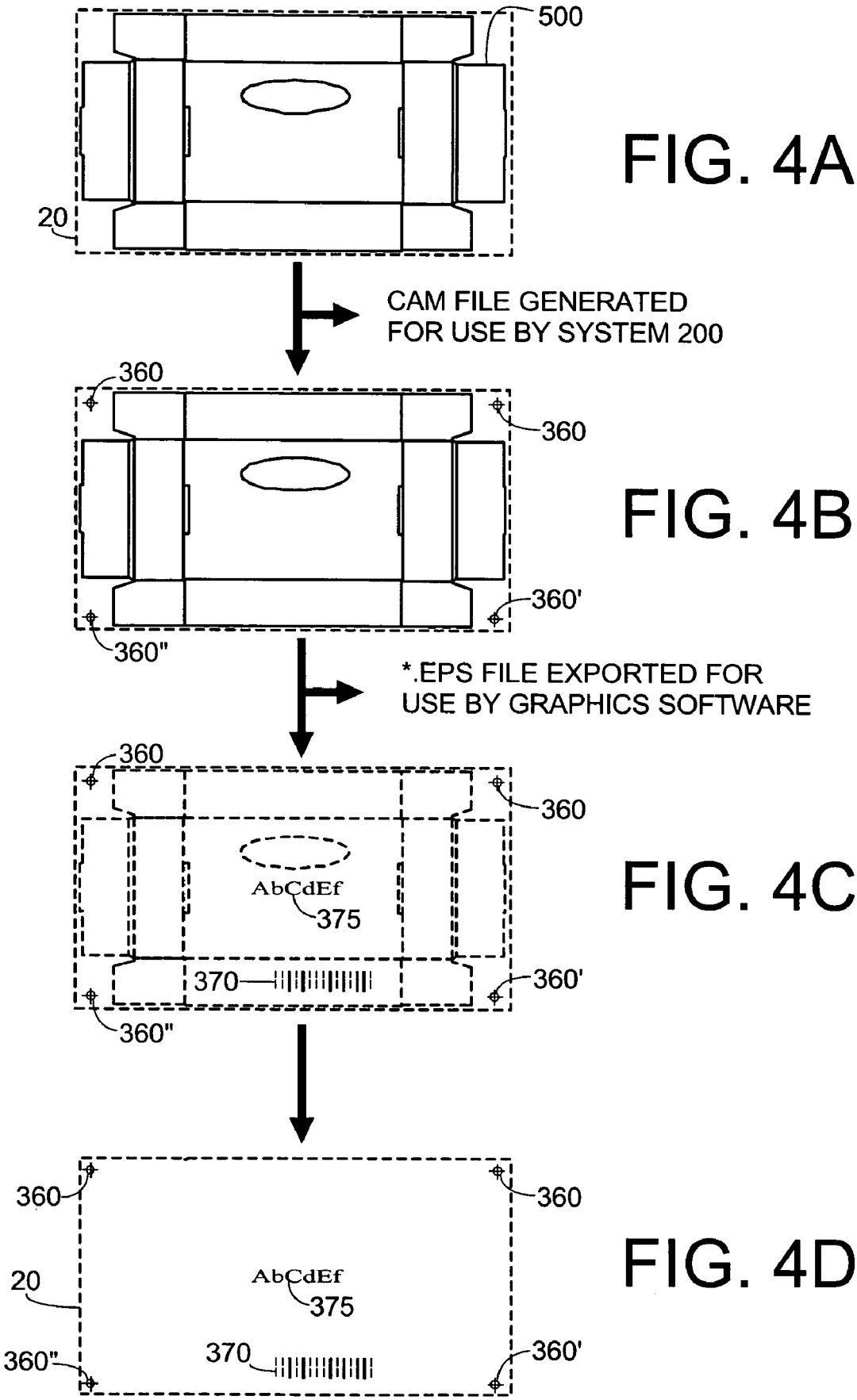
FIGS. 4A–4D depict method steps used to layout alignment of graphics, registration marks, and optional encoded-into-print instructions to be simultaneously printed on a surface of a substrate to be cut and/or scored according to an embodiment of the present invention.

Having briefly described how system 200 can function to accurately score and/or cut a substrate relative to graphics printed on the substrate, a description will now be given as to an exemplary method by which a graphics artist can lay out the carton or box or other structure to be formed from the finished substrate. A typical end use of a substrate exiting out-stack 300 in system 200 might be a three-dimensional box or carton. FIG. 4A depicts the artistic graphic design for a three-dimensional carton or box 500, superimposed on a rectangle (shown in phantom) that represents substrate 20. The outline of substrate 20 is shown as the dimensions of the substrate define the area within which a graphics artist may work in laying out the design for a carton.

For ease of depiction, substrate 20 is shown in FIG. 4A as being slightly larger than might be required. It will be appreciated that if the artistic layout of box 500 can be cut and/or scored from a suitable substrate 20, perhaps corrugated cardboard material, a three-dimensional carton could result from folding the substrate after it was processed, e.g., processed by system 200. The artistic design and layout of box 500 preferably is carried out using a computer system to execute suitable computer aided design (CAD) software, for example ArtiosCad, available from Esko-Graphics located at Gent, Belgium. Once the design and layout of box 500 shown in FIG. 4A is complete, the CAD software can preferably output a common access method type file for use by system 200, more specifically by computer system 260.

As shown by FIG. 4B, still using a software program, e.g., ArtiosCad, the graphics artist will now add registration marks such as 360, and more specifically 360' and 360", to the design of box 500. As noted, when these marks are pre-printed on a substrate 20-U, recognition of these marks by cutting table sensor system 350 enables computer system 260 (or other system) to determine positional and/or rotational offsets to be made to the cutting plan. As such, before actual cutting commences, the relevant cutting plan will have been adjusted as required to ensure a cut line precisely positioned with respect to graphics 375 printed on substrate 20-U, as the substrate lies on cutting table station 230. The term "relevant cutting plan" will be understood to include any optional instructions 370 that either describe changes, or, in an alternative version, the plan. In the embodiment shown in FIG. 2, mechanism 380 will then carry out the desired cutting, which occurs accurately relative to location of graphics 375.

After the process shown in FIG. 4B has been completed the graphics artist causes the software being used to export to file, preferably an encapsulated PostScript file (*.eps) or a PDF file for use by graphics software in subsequent steps shown in FIGS. 4C and 4D. While four marks 360 are shown in FIG. 4B, in practice two such marks can suffice, preferably the two marks denoted 360' and 360" to be printed adjacent what will be the lower edge of substrate 20 in FIG. 4B.

Referring now to FIG. 4C, using graphics software, e.g., ArtiosCad available from Esko-Graphics located at Gent, Belgium, the graphics artist now adds graphics 375 and optional instructions 370, 370' that will be pre-printed on the surface of substrate 20, preferably simultaneously with printing of at least first and second registration marks 360' and 360'.

FIG. 4D shows a substrate 20 that has been printed with registration marks 360, graphics 375, and optional encoded-into-print instructions 370. While FIG. 4D depicts a total of four registration marks 360, as noted in practice printing just two such marks 360', 360" can suffice. Further, while registration marks 360 are depicted as circles within crosshairs, marks 360 having any desired shape may be output by ArtiosCAD or equivalent software. Similarly while optional instructions 370 are shown with one-dimensional barcode format, other formats may instead be used, and as shown in FIG. 2, more than one such set of instructions may be printed on the substrate.

It is understood that graphics 375 may be printed anywhere, even everywhere, on substrate 20. However for ease of illustration, only a simple graphics "AbCdEf" printed in one location is shown. As noted, one problem in the prior art is ensuring that when substrate 20 is cut and/or scored, that the printed graphics appear in good registration on the box, carton, or other object to be fabricated from the processed substrate. If optional encoded-into-print instruction 370 is printed, printing can be on a region of the box or carton that will not be visible to the end-user. For example instructions 370 can be printed on a bottom-facing portion of the three-dimensional box or carton, or on a portion that will be over-covered with a flap or panel of the three-dimensional box or carton. As noted, it is advantageous that at least registration marks 360', 360" and graphics 375 be simultaneously pre-printed to ensure good printing alignment, and optional instructions 370 may also be printed at the same time.

Figure 5A:
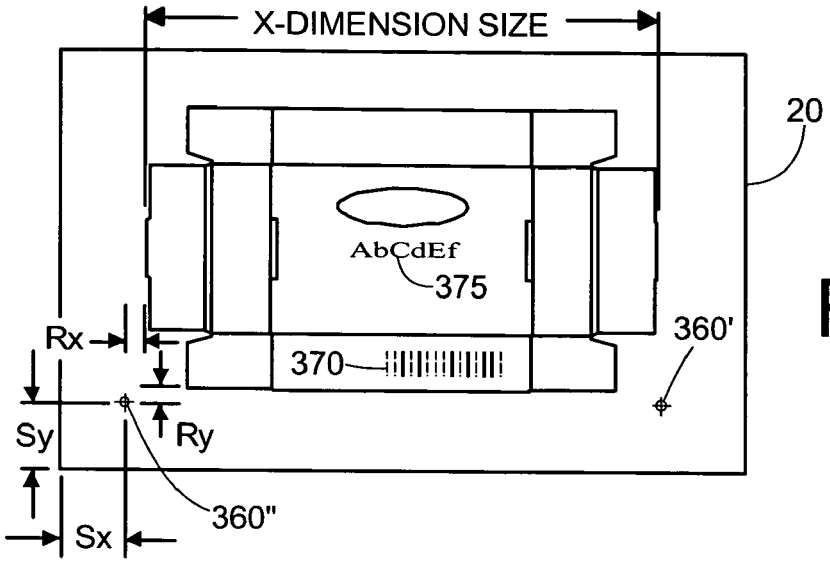
FIG. 5A depicts fixed distances that define location of registration marks to be printed on a substrate, according to an embodiment of the present invention.

According to an embodiment of the present invention, it suffices that the two registration marks 360', 360" be printed on substrate 20 for use in correcting the cutting plan for positional error when the substrate is transported onto cutting table station surface 330. Turning now to FIGS. 5A and 58, a description as to the actual use of first and second registration marks 360' and 360" will be given.

In FIG. 5A, the distances defined adjacent registration mark 360" have been exaggerated for ease of illustration. Dimensions Sx and Sy preferably specify a fixed distance in from the edge of the substrate sheet 20 to the lower left registration mark 360". Dimensions Rx and Ry preferably specify a fixed distance from registration mark 360" to an imaginary rectangle bounding the carton or other object that will be cut from substrate 20. In one embodiment, distances Rx and Ry are fixed for all designs to be cut from the substrate. However as the X-dimension size will vary, the distance between the preferably two registration marks 360', 360" will vary as well. In practice, scaling instructions can be encoded within barcodes 370. Thus, after first and second registration marks 360', 360" are sensed and computer system 260 (or equivalent) modifies the cutting plan to accommodate the actual location of graphics 375 relative to the frame of reference of surface 330, objects of different sizes can be cut automatically from substrate 20-U by system 200.

Figure 5B:
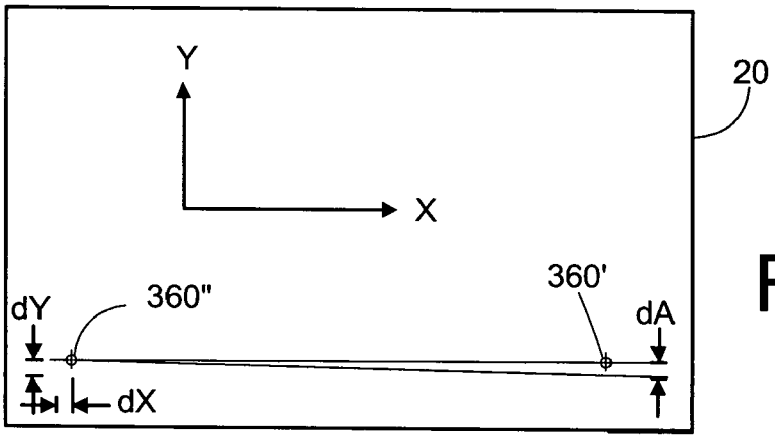
FIG. 5B depicts positional offset definitions, according to an embodiment the present invention.

FIG. 5B defines position offset dimensions dX, dY associated with reference mark 360" on substrate 20, while any rotational offset is represented as dA. As described later herein with reference to FIGS. 7A–7D, the positional offset dimensions and rotational offset together with encoded loadframe positional information enable computer system 260 to modify the cutting plan for use in cutting substrate 20-U.

Figure 6:
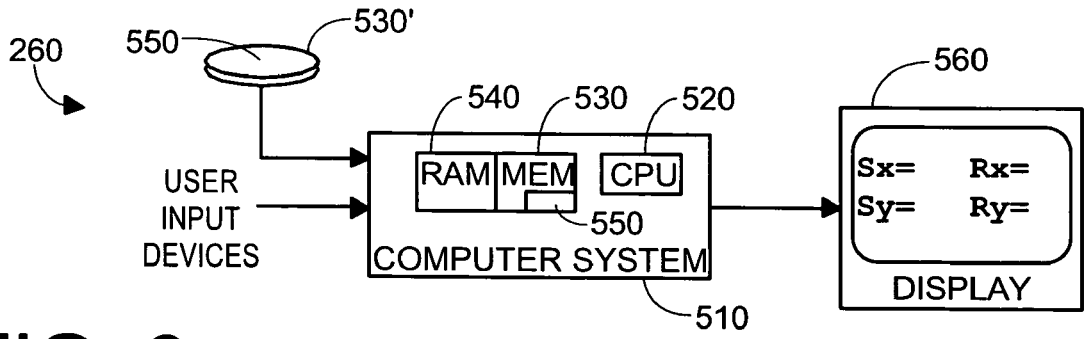
FIG. 6 is a block diagram of an exemplary front-end computer system, according to an embodiment of the present invention.

It is useful at this juncture to describe an exemplary computer system 260 used in one embodiment of the present invention to enter offset values Sx, Sy, Rx and Ry. Referring to FIG. 6, front-end computer system 260 includes a computer system 510 per se, a CPU 520 and memory that typically includes persistent memory 530 and non-persistent memory 540. Stored or loadable into memory 530 is a software program 550 that when executed by CPU 520 will cause the methodology of the present invention to be carried out. As indicated in FIG. 3, in some systems program 550 may be stored on external substrate 530', perhaps optical or magnetic storage, to be read into computer system 510. Those skilled in the art will recognize the storage substrate 530' may in fact be physically remote from computer system 510, and may, if desired, be accessed over a communications link such as the Internet, a network, etc. In general, by a carrier medium is meant any medium able to carry instructions that form some or all of the computer program.

Typically the user of front-end computer system 260 can use one or more input devices such as a mouse, a trackball, a joystick, a digitizer tablet, or a computer keyboard to control system 200. For example, in one embodiment offset values Sx, Sy, Rx, and Ry preferably are entered into system 260 and maintained from a graphical user interface (GUI) dialog presented on monitor 560, which is coupled to computer system 510. Referring to FIG. 5A, the X-size dimension may be calculated from an input program file 550, stored for example in memory 530, 530', and associated with bar-encoded data 370 that is printed on the substrate to be processed by system 200. Alternatively, values for Sx, Sy, Rx, and Ry may follow the program file 550. One or more template cutting plans may also be contained within program file 550, or otherwise stored within (or loadable into) memory 530.

Referring briefly to the embodiment shown in FIG. 2, cutting table sensor system 350, for example a camera, may be manually adjusted along the y-axis by a human operator, or may be servo-manipulated by computer system 260. For example, tool head mechanism 380 preferably includes a downward pointing laser 385. The location of the light beam from laser 385 upon substrate 20-U permits rapid determination and input of the desired Y-axis coordinate location for the camera (or other device) in system 350.

In one embodiment, program 550 includes a so-called wizard set of instructions that display on monitor 560 a command inviting the human operator to "obtain camera position" and to input such data into computer system 210. Preferably each time the position of camera system 350 is changed, the wizard will display the "obtain camera position" instructions to prompt the operator to input coordinate information to the system.

A single camera or equivalent sensor 350 can suffice to locate pre-printed registration marks 360 on a substrate 20. Also needed is information regarding movement of loadframe 290 to acquire at least first and second images from camera 350 in positions that properly represent detected locations of registration marks 360', 360".

Using image data acquired from sensor 350, computer system 260 (or equivalent) can execute a software program, perhaps program 550, to calculate proper cutting plan coordinate offsets (Sx, Sy, Rx, Ry) including any required adjustment for rotational position of substrate 20-U on surface 330. Once coordinate correction has been made by computer system 510 to the cutting plan to account for precisely how substrate 20-U lies upon surface 330, mechanism 380 can commence cutting the substrate. Since graphics 275 will preferably have been pre-printed simultaneously with registration marks 360', 360", the cut line will be precisely aligned with the graphics on the substrate.

In one embodiment, graphics 375, registration marks 360 and any encoded-into-print instructions 370 are printed on the upper surface of substrate 20-U, and the registration marks and instructions are sensed from above the substrate. In this embodiment, cutting is carried out from the lower surface of the substrate, although top-side cutting could instead be used.

As noted, in one embodiment, loadframe 290 position is feedback, for example via encoder 570 (see FIGS. 7A–7D) as input to computer system 260 or as input to another local computing unit (LCU). In this embodiment, encoder 570 feedback is used to identify four discrete loadframe positions that will now be described with respect to FIGS. 7A–7D.

In plan view FIG. 7A, the right upper edge of uppermost substrate 20-U has been grasped with vacuum suction cups 450 associated with loadframe 290. This starting loadframe position will be denoted "zero-position". In FIGS. 7A–7D, the first and second registration marks are denoted 360' and 360", for ease of explanation of the figures.

In FIG. 7B, loadframe 290 continues its rightward movement along the x-axis, thus beginning to transport substrate 20-U from in-stack region 210 towards cutting table region 230. As soon as camera or sensor system 350 detects the presence of first registration mark 360', an image is acquired by the camera. Since the x-coordinate location of loadframe 290 is known to computer system 260 (or equivalent), this second loadframe position at which a first image is acquired enables determination of distance from "zero position" to first registration mark 360'.

Loadframe 290 continues to transport substrate 20-U along the x-axis and in FIG. 7C when second registration mark 360" is recognized by camera 350, a second image is acquired. Since the x-coordinate of loadframe 290 is known to computer system 260 (or equivalent), the distance from "zero position" to second registration mark 360" can be determined.

In FIG. 7D, loadframe 290 has completely transported substrate 20-U from in-stack region 210 onto surface 330 of cutting table station 230. Cutting table station 230 is depicted in FIGS. 7A–7D. X-axis coordinate information acquired from the loadframe position in FIG. 7D enables calculation of exact offsets (Sx, Sy, Rx, Ry) to be used by computer system 260 (or 510) in correcting the cutting plan. As corrected, the cutting plan will precisely take into account the actual position and orientation of substrate 20-U upon cutting table station 230 and, if present, instructions contained in barcodes 370 as well.

In one embodiment, loadframe 290 can transport substrates along the x-axis at a high speed. In this embodiment, cutting table sensor system 350 is a camera operable whose shutter is adequate to acquire an image of first registration mark 360' (see FIG. 5B). With respect to recognizing second registration mark 360", maximum transport speed of loadframe 290 preferably is reduced to maintain acceptable positional error. In an alternate embodiment, the movement is stopped. An example of a relatively high speed is about 2 m/s. The speed in one embodiment is reduced to about 0.5 m/s, although any speed adequate to maintain the acceptable error will work. In one embodiment, the error was maintained under about 50 μm.

Thus loadframe 290 preferably has a dynamic transport velocity. The velocity can be relatively rapid as sensor system 350 acquires an image of first registration mark 360', but transport velocity should then be reduced to ensure accurate acquisition of an image of the second registration mark 360". It will be appreciated that various velocity profiles may be programmed into system 200 to promote high-speed transport velocity while ensuring adequate accuracy of the image acquired for the second registration mark. For example if the X-dimension size is known by system 200 to be large, then the relatively rapid transport velocity can be maintained for a longer time between registration mark 360' and the vicinity of registration mark 360".

It will be appreciated that the window frame of cutting station camera sensor system 350 should encompass the size of registration mark 360' or 360". This requirement follows from the window frame size determining the maximum allowable error in positioning substrate 20-U atop cutting table station 230. In practice, the ΔT thickness of various types of substrates 20 may vary from perhaps 1 mm or so to at least 20 mm, and thus the focal length of cutting station sensor system 350 must encompass the foreseeable ranges of substrate thickness.

Figure 8:
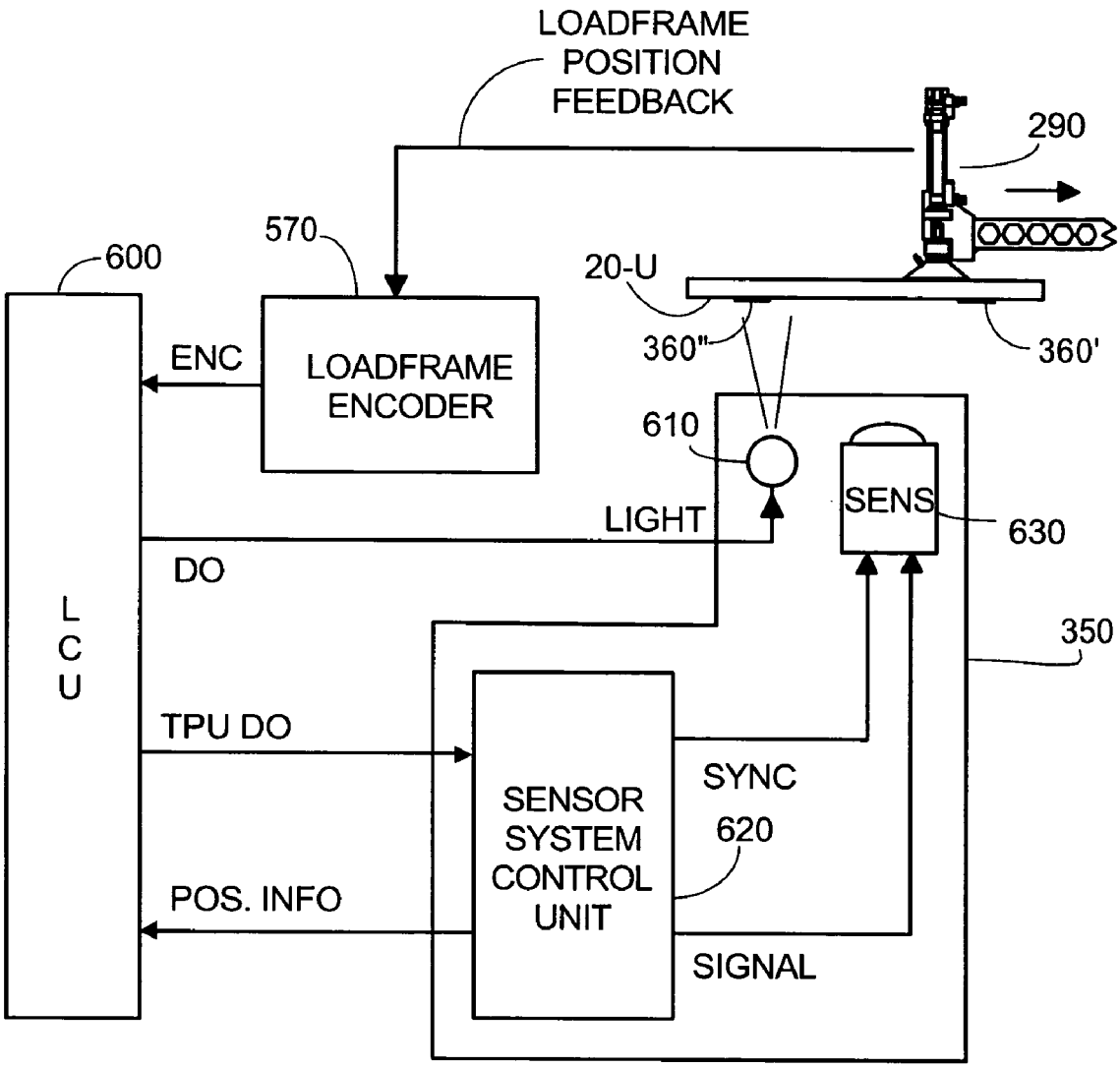
FIG. 8 is a block-flow diagram showing the functional relationship between various signals associated with acquisition of registration mark images by the cutting table sensor system, according to an embodiment of the present invention.

FIG. 8 depicts the functional inter-relationship between various control and timing signals used to synchronize cutting table sensor system 350 for an embodiment of the present invention. Local computing unit (LCU) 600 may, but need not be, a sub-system of computer system 260, as depicted in FIG. 5. Among other tasks, LCU 600 (or equivalent) outputs a DO signal commanding a light source 610 to illuminate the field of view of the camera 630 portion of cutting table sensor system 350. Light source 610 may in fact be strobe-operated under control of the DO signal. In such an embodiment, absent light from light source 610, camera 630 cannot see registration marks 360', 360".

Preferably LCU 600 further outputs a TPU DO signal as input to a control unit 620 that synchronously controls shutter operation of camera sensor 630 within sensor system 350. As shown in FIG. 8, LCU 600 receives encoding information from loadframe encoder 570. Control unit 620 includes internal processing capability and can output back to the LCU x-axis coordinate position as to location of each image acquired by sensor 630, e.g., a first image of registration mark 360', and a second image of registration mark 360". Any or all of this information acquired by system 350 is coupleable to computer system 260 for further processing, if necessary.

In summary it is seen that aspects of the present invention provide a high performance, automated short run cutting and scoring system. System performance is enhanced at least in part due to a dynamic loadframe velocity that can maintain high system throughput while ensuring acceptably good alignment mark position measurement accuracy. Rapidly acquired images of the first and second registration marks enable dynamic correction to the substrate cutting plan to account for the actual position of the substrate on the cutting table station. The amended cutting plan can also take into account any option encoded-into-print instructions. Since the graphics and at least the first and second registration marks will preferably have been pre-printed simultaneously, aspects' of the present invention can cut with good precision and alignment relative to the graphics printed on the substrate surface.

Modifications and variations may be made to the disclosed embodiments without departing from the subject and spirit of the invention as defined by the following claims.

We claim:

1. A method of cutting and/or scoring a substrate according to an amendable cutting plan relative to graphics printed on an upper or lower surface of the substrate, the method comprising the following steps:

(a) pre-printing on said surface of said substrate said graphics, and at least a first registration mark and a second registration mark;

(b) automatically transporting said substrate from an in-stack region to a cutting table station along an x-axis, said cutting table station defining a reference frame;

(c) while step (b) is carried out, optically detecting presence of said first registration mark and detecting position thereof relative to said cutting table station reference frame;

(d) while step (b) is carried out and subsequent to step (c), detecting presence of said second registration mark and detecting position thereof relative to said cutting table station reference frame;

(e) using positional information acquired at step (c) and at step (d) to amend said cutting plan as needed to account for actual position and orientation of said substrate on said cutting table station; and (f) cutting and/or scoring said substrate according to said cutting plan as amended at step (e).

2. The method of claim 1, further including:

reducing transport velocity or stopping movement of said substrate between step (c) and step (d) so as to maintain acceptably good transport throughput while maintaining acceptable accuracy of positional measurement at step (d).

3. The method of claim 1, wherein step (f) is carried out from a lower surface of said substrate.

4. The method of claim 1, wherein said surface of said substrate is pre-printed with at least one set of encoded-into-print instructions; and step (e) includes further amending said cutting plan according to said encoded-into-print instructions.

5. The method of claim 1, wherein step (e) enables human input of correctional information.

6. The method of claim 1, wherein transport velocity of said substrate is in a range up to 2 m/sec.

7. The method of claim 1, wherein step (d) achieves x-axis positional accuracy of said second registration mark within an acceptable range.

8. The method of claim 1, wherein steps (b), (c), (d), and (e) are carried out under computer control.

* * * * *